United States Patent [19]

Niedermeyer

[11] 3,941,507

[45] Mar. 2, 1976

[54] SAFETY SUPERVISOR FOR SUMP PUMPS AND OTHER HAZARDS

[76] Inventor: Karl O. Niedermeyer, 17W068 North St., Bensenville, Ill. 60106

[22] Filed: Apr. 12, 1974

[21] Appl. No.: 460,423

[52] U.S. Cl. ..... 417/2; 417/40; 417/44; 320/2

[51] Int. Cl.[2] ..... F04B 49/06

[58] Field of Search ..... 417/36, 40, 44, 2; 340/244; 320/2 H, 37 I, 37 C, 39 R, 39 E, 39 Y

[56] References Cited

UNITED STATES PATENTS

| | | | |
|---|---|---|---|
| 2,922,854 | 1/1960 | Nielsen | 417/38 |
| 3,634,842 | 1/1972 | Niedermeyer | 340/244 |
| 3,656,866 | 8/1972 | Hine | 417/38 |
| 3,726,606 | 4/1973 | Peters | 417/40 |
| 3,814,544 | 6/1974 | Robert et al. | 417/40 |
| 3,867,681 | 2/1975 | Bishop et al. | 320/37 |

*Primary Examiner*—William L. Freeh
*Assistant Examiner*—S. P. LaPointe

[57] ABSTRACT

A sump containing a conventional sump pump has a battery operated emergency pump. A trapped air pressure operated switch turns the emergency pump on when the water level rises excessively in the sump and an alarm signal is given. If the trapped air operated switch fails to turn the pump on, a non-mechanical float switch does so after a further rise in the liquid level in the sump and at the same time an emergency warning signal is produced. The float switch also turns on the emergency pump if that pump had not previously been turned on due to a malfunction in the trapped air switch. When the emergency pump turns on, a battery charger is energized from the alternating current supply so as to prevent depletion of the battery so long as the alternating current is available. Normally, the battery charger is turned on periodically by a timer to maintain adequate battery charge on a regulated basis. If battery power fails alarm is actuated. An alarm is actuated when alternating current power failure occurs. Low level of battery electrolyte is indicated by an alarm. Provision is made for connection of sensors for other detrimental conditions, e.g., fire, burglar, freezer temperature, etc. Included in the alarm signals available is the actuation of an automatic telephone dialer to summon assistance.

36 Claims, 2 Drawing Figures

SAFETY SUPERVISOR FOR SUMP PUMPS AND OTHER HAZARDS

BACKGROUND AND SUMMARY OF THE INVENTION

For many years sump pumps have been employed in low locations, e.g., basements of homes and business buildings, to protect against undesired accumulations of water such as may occur as a result of heavy rains, sewer blockages, etc. It is not uncommon for these sump pumps to fail either by reason of electrical power failure, such as often occurs as a result of a bad storm, or by reason of a functional failure in the pump or its motor. To guard against such malfunctions supplemental, battery operated, pumps are employed in the sump to take over when the primary pump fails. One such apparatus is described in my prior U.S. Pat. No. 3,634,842. However, it is still possible for failures to occur in the supplemental pump or its power supply. While the likelihood is small that failure of both the main pump or its power supply and the supplemental pump or its power supply will occur, there are often situations where it is important to guard against that unlikely possibility. For example, a suburban bank may have its computer located in the basement. That computer and the data stored therein represents a very sizeable investment and it is just unthinkable to permit it to be subjected to water damage, or being put out of operation by reason of water in the basement. In such situations it is extremely important that any malfunction in either the pumps or their power supply be brought to the attention of appropriate personnel so that remedial action can immediately be taken.

The necessity for such supervisory protection against detrimental conditions is not limited to commercial buildings. For example, there are many homes that have expensively furnished recreation or family rooms in the basement. Owners of such homes are desirous of having the same degree of protection.

Furthermore, in both homes and commercial establishments there is increasing use of other devices for protecting against detrimental conditions, e.g., fire alarms, burglar alarms, freezer temperature alarms, etc. Often these devices are sold and installed as individual units; however, this will usually involve some redundancy of components. In the present invention provision is made for connecting the sensors for such malfunctions, etc., e.g., heat or smoke detectors, burglar alarm switches, freezer temperature detectors, etc. This eliminates the redundancy of components since only the sensors for such other malfunctions, etc., are required, along with the associated wiring, and usually will effect a monetary saving since the redundancy has been eliminated. Furthermore, it results in a centralization of the alarm indications. The present invention also makes provision for remote indication of the malfunctions, etc. One of such indications is in the form of an automatic telephone dialer which can summon assistance by means of an appropriate message.

Thus, the present invention relates to a sump protective apparatus which supervises the equipment involved and supplies suitable alarm indications by reason of the malfunction of the various components and which also can signal the existence of various other undesired conditions in a building.

Further objects and advantages will become apparent from the following description taken in conjunction with the drawings.

DESCRIPTION OF SPECIFIC EMBODIMENTS

The following disclosure is offered for public dissemination in return for the grant of a patent. Although it is detailed to ensure adequacy and aid understanding, this is not intended to prejudice that purpose of a patent which is to cover each new inventive concept therein no matter how others may later disguise it by variations in form or additions or further improvements.

Figure 1:
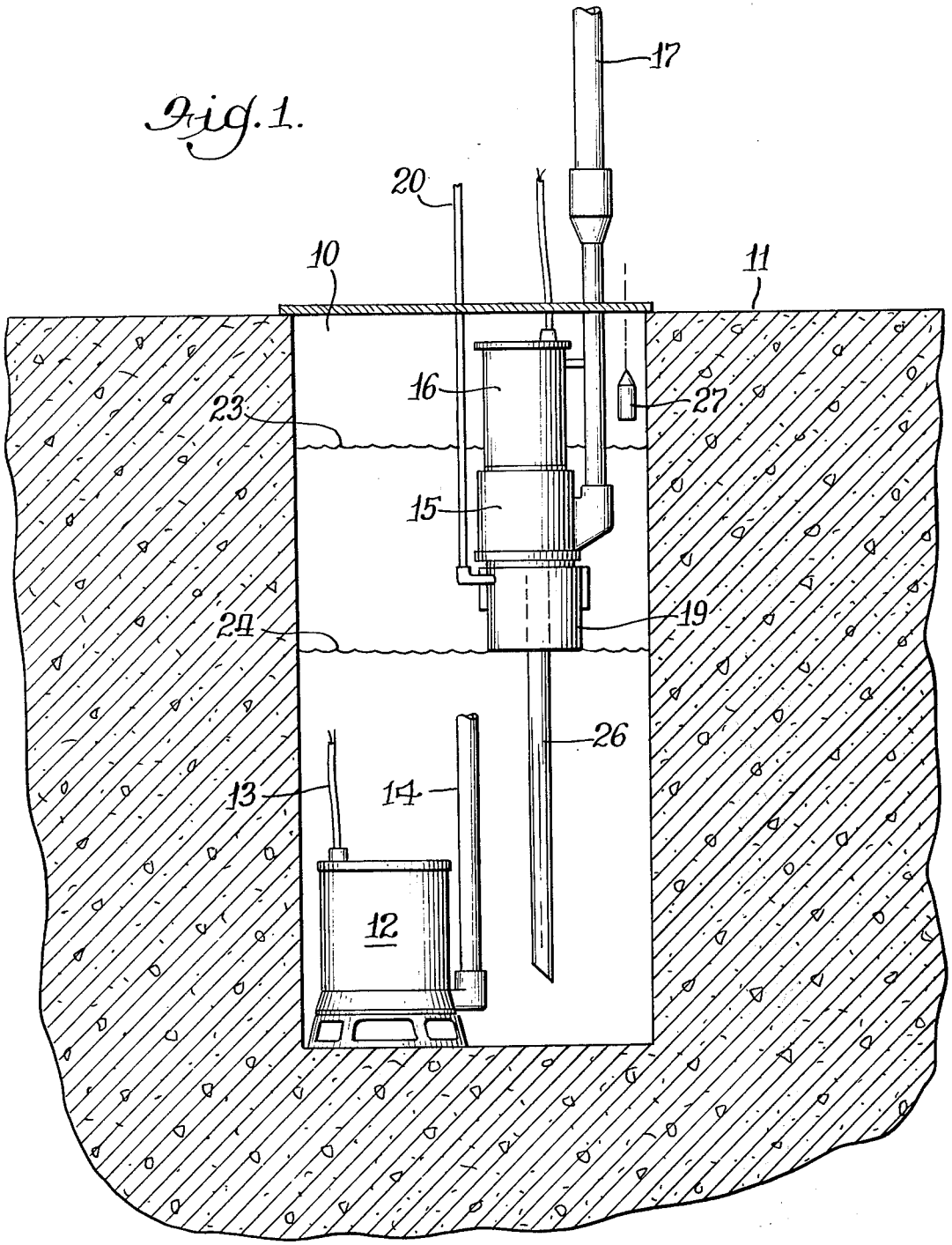
FIG. 1 is a sectional view of a sump showing the primary and secondary pumps therein.

FIG. 1 illustrates a sump pit 10 located, for example, below a basement floor 11. Within this sump pit is a conventional sump pump 12 connected by wires 13 to 110 volt A.C. supply. The pump discharges through a pipe 14 to a suitable location for disposing of the water. A secondary or back-up pump 15 is employed which is operated by a 12 volt D.C. motor 16. Pump 15 likewise discharges through a pipe 17 to a suitable location for disposing of the water. As thus far described, the illustrated apparatus is representative of conventional installations.

Figure 2:
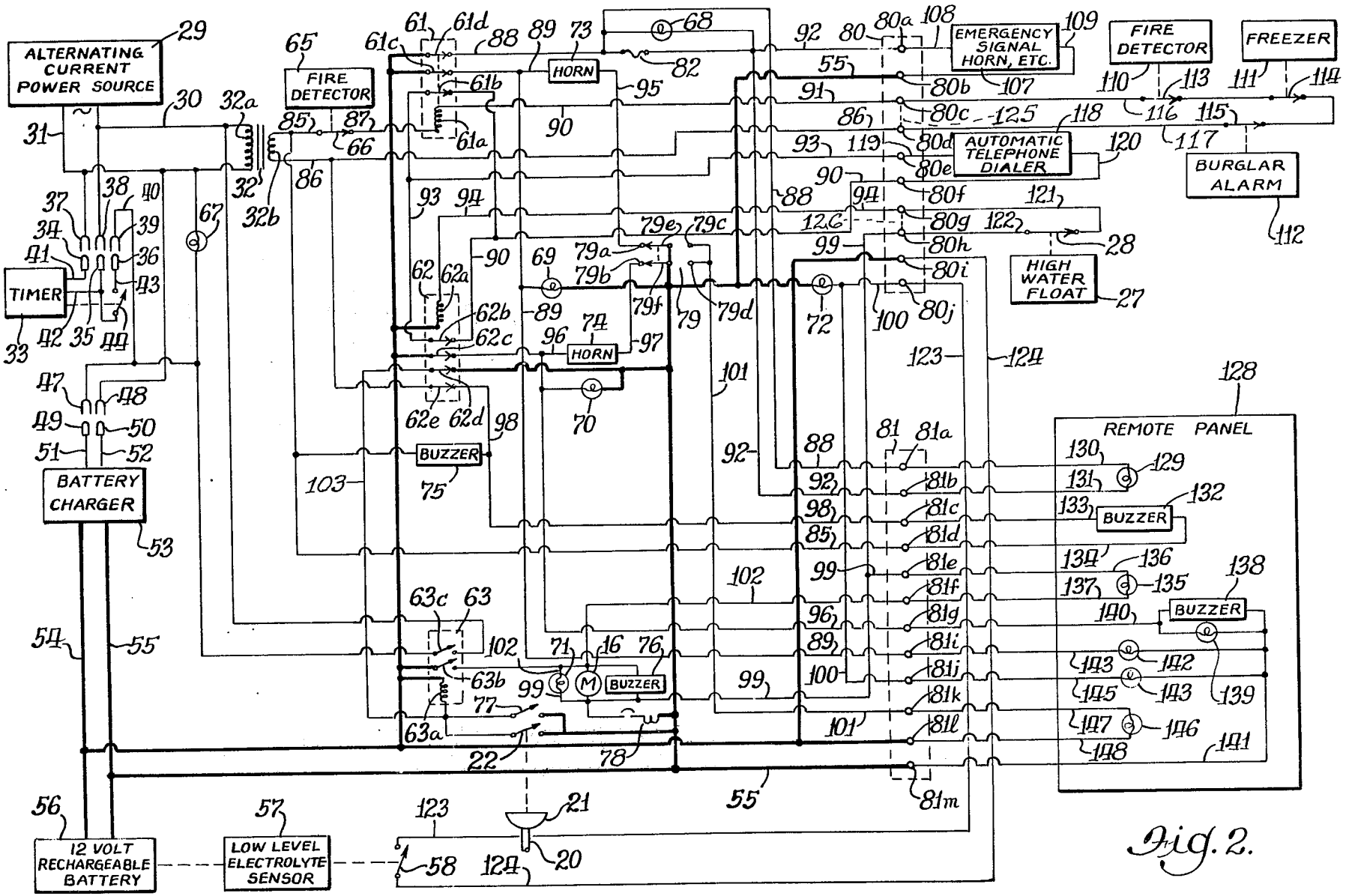
FIG. 2 is a schematic wiring diagram of an embodiment of the invention.

Extending downwardly from the pump 15 is a bell or housing 19 which is open at the bottom and otherwise fluid tight. A plastic tube or pipe 20 communicates with the interior of bell 19. Referring to FIG. 2, it will be seen that tube 20 communicates with a pressure sensitive actuator 21 which operates an electrical switch 22 in the sense such that switch 22 is normally open and is closed with an increase in air pressure (as compared to ambient) within the actuator 21. As the water level in the sump 10 raises above the bottom of the bell 19, there is an increase in the pressure of the air trapped in the bell. As the water level rises to approximately the level indicated by line 23, the air pressure is sufficient to close switch 22. The switch remains closed until the water level drops nearly to the bottom of the bell, as indicated by line 24. Switch 22 then opens. As hereinafter described, switch 22 is employed to energize motor 16.

In prior art apparatus float switches have been employed for this purpose. Float switches have the disadvantages that there is very little difference between the liquid level that will turn the motor on and the level that turns the motor off. This results in a comparatively rapid cycling of the motor on and off. By the use of the bell and the pressure actuated switch, there can be a substantially greater difference in water level between what will turn the motor on and that which turns it off. This results in the motor running for longer periods of time and longer lapses of time between each occurrence of motor operation.

Extending downwardly from pump 15 is an intake tube 26 open at the bottom. This tube should terminate above the bottom of the sump (so that sediment from the bottom will not be drawn in) and below the level at which the regular pump 12 will operate (so as to prevent floating debris from entering the intake tube and causing a malfunction). Also illustrated in FIG. 1 is a float 27 which incorporates and operates an electrical switch 28, illustrated in FIG. 2. As there described, its function is to serve as a backup switch to sound an alarm in the event of failure of the latter, failure of the pumps to keep up with the incoming water, etc. Thus, float 27 is located above the normal high water line 23, as seen in FIG. 1.

Referring to FIG. 2, power supply wires 30 and 31 are connected to a normal A.C. power source 29, e.g., a wall receptacle. Actual embodiments will include a third wire which connects to ground (to ground the various components), but this has not been illustrated since it is conventional and would unnecessarily add to the complexity of the wiring diagram. Wires 30 and 31 are connected to the primary 32*a* of a stepdown transformer 32. The voltage at secondary winding 32*b* is 12 volts A.C. A plug-in timer 33 is employed. It has three plugs 34–36 (suitably polarized) which are received in sockets 37–39. Wires 30 and 31 connect to sockets 38 and 37. A wire 40 connects to socket 39. Wires 41 and 42 connect to the timer. Wires 42 and 43 connect to the two sides of a switch 44 which is operated by the timer.

Sockets 47 and 48 are connected to wires 40 and 31 respectively and are associated with plugs 49 and 50. Wires 51 and 52 connect plugs 49 and 50 to a battery charger 53. Charger 53 is connected by wires 54 and 55 to a 12 volt rechargeable battery 56. An electrolyte level sensor 57 is employed in battery 56 and closes a switch 58 when the electrolyte in the battery is low.

Three relays 61, 62 and 63 are employed. It will be apparent to those in the control art that solid state electrical switches, e.g., silicon controlled rectifiers, could be substituted. Fluidic control systems would also be substituted. Relay 61 forms the heart of an A.C. supervisory circuit and has an operating solenoid 61*a* (a control element) and three normally closed switches 61*b*, 61*c* and 61*d*. Relay 62 is the heart of a D.C. supervisory circuit and has a solenoid 62*a* (a control element) and four normally closed switches 62*b*, 62*c*, 62*d*, 62*e*. Relay 63 has solenoid 63*a* (a control element) and two normally open switches 63*b* and 63*c*. Relay 63 functions to turn on the D.C. pump motor 16 when energized.

There is a fire detector 65 (heat or smoke sensitive) which operates a normally closed switch 66 when a fire is detected. There are signal lights 67–72 of various colors and types. Audible signals are provided by horns 73 and 74 and buzzers 75 and 76. There is a normally open test switch 77 and a circuit breaker 78. There is a double-pole double-throw switch 79 having contacts 79*a*, 79*b*, 79*c*, 79*d* and switch arms 79*e* and 79*f*. Two terminal boards 80 and 81 are employed. Terminal board 80 has terminals 80*a* through 80*j*. Terminal board 81 has terminals 81*a* through 81*m*. A fuse 82 is employed for the external signaling circuit.

Wire 54 connects to solenoid 63*a*, switch 63*b*, switch 62*e*, solenoid 62*a*, switch 61*c*, switch 61*d*, terminal 81*l* and terminal 80*i*. Power supply wire 55 connects to switches 22 and 77, circuit breaker 78, signal light 70, switch 62*d*, signal light 69, switch arms 79*e* and 79*f*, signal light 72, terminal 80*b* and terminal 81*m*. A wire 85 connects secondary 32*b* to switch 66, buzzer 75 and terminal 81*d*. A wire 86 connects secondary 32*b* to switch 62*e* and terminal 80*d*. A wire 87 connects switch 66 to solenoid 61*a*. A wire 88 connects switch 61*d* to fuse 82, signal light 68 and terminal 81*a*. A wire 89 connects switch 61*c* to horn 73. A wire 90 connects switch 61*b* to switch 62*b* and terminal 80*f*. A wire 91 connects solenoid 61*a* to terminal 80*c*. A wire 92 connects signal light 68, fuse 82 and terminal 81*b*. A wire 93 connects switch 61*b*, switch 62*b* and terminal 80*e*. A wire 94 connects solenoid 62*a* and terminal 80*g*. A wire 95 connects horn 73 to contact 79*a*. A wire 96 connects switch 62*e* with horn 74, signal light 70 and contact 81*g*. A wire 97 connects horn 74 with contact 79*b*. A wire 98 connects switch 62*e*, buzzer 75 and terminal 81*c*. A wire 99 connects terminal 80*h* and terminal 80*e* to buzzer 76, motor 16, signal light 71 and circuit breaker 78. A wire 100 connects terminal 80*j*, signal light 72 and terminal 81*j*. A wire 101 connects contacts 79*c* and 79*d* to terminal 81*k*. A wire 102 connects terminal 81*f* to buzzer 76, motor 16, signal light 71 and switch 63*b*. A wire 103 connects switches 22 and 77, solenoid 63*a* and switch 62*d*.

At a remote location is a sensible signaling device 107, such as a horn, buzzer, light, etc. It is connected by wires 108 and 109 to terminals 80*a* and 80*b*. If it is desired to use various other malfunction or alarm sensors, such as fire detector 110, freezer high temperature alarm 111, burglar alarm 112, etc., with the sensors having normally closed switches 113, 114 and 115, respectively, the switches are connected in series with terminals 80*c* and 80*d* by wires 116 and 117. An automatic telephone dialer 118 is connected across terminals 80*e* and 80*f* by means of wires 119 and 120. This dialer is also connected to the telephone lines (not shown). It may be of the type that provides a recorded message after it dials a selected number. Switch 28 is connected across terminals 80*g* and 80*h* by wires 121 and 122. Switch 58 is connected across terminals 80*i* and 80*j* by wires 123 and 124. If external sensors 110, 111, 112, etc., are not employed a jumper 125 is placed between terminals 80*c* and 80*d*. Similarly, if switches 28 or 58 are not employed a jumper (e.g. 126) is placed across the respective terminals.

Terminal board 81 is employed if desired to provide sensible signals, e.g., sound or light, at a remote location. Thus the remote panel 128 includes a light 129 connected by wire 130 and 131 to terminals 81*a* and 81*b*; a buzzer 132 connected by wires 133 and 134 to terminals 81*c* and 81*d*; a light 135 connected by wires 136 and 137 to terminals 81*e* and 81*f*; a buzzer 138 and a light 139 connected by wires 140 and 141 to terminals 81*g* and 81*m*; a light 142 connected by wires 143 and 141 to terminals 81*i* and 81*m*; a light 144 connected by wires 145 and 141 to terminals 81*j* and 81*m*; and a light 146 connected by wires 147 and 148 to terminals 81*k* and 81*l*. It is to be understood that various forms of sensible signals can be employed alternatively with those of the described embodiment. A buzzer or light could be used in place of a horn and vice versa. The lights would be various colors so that they could be readily distinguished. All of this would depend upon the desires and the preferences of the particular manufacturer and/or user.

NORMAL STANDBY OPERATION

FIG. 2 illustrates the situation with neither A.C. nor D.C. power being applied. With battery 56 having a reasonable charge and alternating current applied to wires 30 and 31 the normal standby operation would be as follows. Relay coil 61*a* of the A.C. supervisory circuit is energized from transformer secondary 32*b*, the energizing circuit including switch 66 and the normally closed switches connected across terminals 80*c* and 80*d*. The energizing of this relay holds relay switches 61*b*, 61*c* and 61*d* open. Relay coil 62*a* of the D.C.

supervisory circuit is energized, one side of the coil being connected to D.C. supply wire 54 and the other side of the coil being connected to D.C. supply wire 55, through wire 94, terminal 80*g*, wire 121, closed switch 28, wire 122, terminal 80*h*, wire 99, and closed circuit breaker 78. This opens relay switches 62*b*, 62*c*, 62*d* and 62*e*. Relay coil 63*a* of the circuit for operating pump motor 16 is deenergized because switches 22 and 77 are open. The timer 33 is operating, but because switch 44 is open the battery charger 53 is deenergized. Periodically, depending upon the interval which the user has set into the timer 33, switch 44 will be closed by the timer for a given period of time. When switch 44 is closed, this energizes battery charger 53 and the battery is charged for a preselected period of time (as determined by the timer setting) to maintain the charge in the battery. The fact that the charger is operating is indicated by light 67. The charger is one which has a built-in regulator to reduce the charging rate when the battery is high and vice versa. However, by turning it off completely for a substantial part of each 24 hours eliminates excessive battery charging.

SECONDARY SUMP PUMP OPERATION

When the primary sump pump 12 fails or is unable to keep up with the demand and the water level in the sump rises approximately to the level indicated by line 23, the air pressure in bell 19 closes switch 22. This energizes relay coil 63*a*, resulting in the closing of relay switches 63*b* and 63*c*. Switch 63*b* connects motor 16 across the two power supply wires 54 and 55 to put the auxiliary sump pump into operation. The fact that it is operating is signaled by light 71 and buzzer 76. Also, light 135 on the remote panel will indicate that the pump is in operation. Switch 63*c* is in parallel with timer switch 44 so that its closing has the same effect of energizing battery charger 53. This means that in normal operation the motor 16 will, in effect, be operating from the battery charger and will not result in any significant dissipation of the charge in battery 56. The fact that the battery charger is operating will be signaled by light 67. Switch 77 is a test switch. If it is desired periodically to test the operation of the emergency pump, switch 22 being open, it is only necessary to manually close switch 77 to achieve the same result as would occur by reason of the closing of switch 22. When both switches 22 and 77 are open this deenergizes relay coil 63*a* turning off lights 71 and 135, motor 16, buzzer 76, battery charger 53 and light 67.

FAILURE OF SECONDARY SUMP PUMP

There are two provisions for possible detection of failure of the secondary sump pump 15, 16. One of these is that if the water level in the sump 10 rises sufficiently high to actuate float 27, this will open switch 28. The opening of switch 28 will deenergize relay coil 62*a* of the D.C. supervisory circuit, since the connection from that relay coil to power supply wire 55 is through wires 94 and 121, switch 28, wires 122 and 99 and circuit breaker 78. This results in relay switches 62*b*, 62*c*, 62*d* and 62*e* all closing. The closing of switch 62*c* energizes horn 74 and light 70 to thereby produce sensible signals. The light 70 identifies which horn is operating. The horn can be silenced by changing the position of switch 79, and this causes light 146 to be turned on to warn of the fact that the horn has been silenced. The closing of switch 62*e* energizes buzzer 75 to also produce a sensible signal. The latter is A.C. energized while the horn is D.C. energized. Thus a failure in one or the other of the power supplies will still result in a signal being produced. On the remote panel the buzzers 132 and 138 will be energized along with light 139. The closing of switch 62*b* actuates automatic telephone dialer 118 to call for assistance. Incidentally, this provides for a person away from home checking on the condition of the system. If he calls his telephone number and gets a busy signal this would be an indication that the automatic telephone dialer is using the line. In some installations switch 62*b* (and switch 61*b*) may be connected directly across the telephone lines to close the circuit therebetween with the same result as though the telephone were in use.

Switch 62*d* is in parallel with switches 22 and 77. The closing of switch 62*d* energizes relay coil 63*a* so as to energize motor 16 in the event that switch 22 failed to operate properly to turn on the motor.

The second check on the operation of the secondary sump pump is provided by circuit breaker 78. Should, for example, motor 16 be overloaded and thus draw excessive current, the circuit breaker 78 will open. This has the same effect as if switch 28 opened as described in the preceding paragraph (since they are both in the same series circuit for energizing relay coil 62*a*).

POWER FAILURE

Should the A.C. power fail, this would deenergize relay coil 61*a* of the A.C. supervisory circuit causing switches 61*b*, 61*c* and 61*d* to close. The closing of switch 61*b* actuates the automatic telephone dialer 118, as previously described with respect to switch 62*b*. The closing of switch 61*c* energizes horn 73 and light 69. It also energizes light 142 on the remote panel 128. Switch 61*d* energizes external signal 107. This external circuit is protected by fuse 82. Should fuse 82 fail, light 68 will be illuminated as well as light 129 on the remote panel.

Should the D.C. power fail, or become inadequate for effective operation, this lack of power will not energize relay solenoid 62*a* of the D.C. supervisory circuit sufficiently to hold the switches 62*b*–62*e* open and these latter switches will then close. The closing of switch 62*e* will result in buzzers 75 and 132 being energized (from the A.C. source). The closing of switch 62*b* will actuate the automatic telephone dialer 118.

It should be noted that even if both the A.C. and D.C. power fails, switches 61*b* and 62*b* still will close to actuate the automatic telephone dialer. Thus, the failure of both the power sources will still result in an emergency signal being produced so long as the automatic telephone dialer is effective.

LOW BATTERY ELECTROLYTE

Should the electrolyte in the battery decrease in volume to an extent such that there is a need for the addition of distilled water to the battery, switch 58 will close. This will energize lights 72 and 143 thereby identifying the need for attention to the battery.

FIRE OR OTHER EMERGENCY CONDITION

Fire detector 65 is a part of the main unit with the sensor being mounted on an external face of the housing for the main unit. Should a fire thereby be detected, switch 66 will be opened. This will deenergize relay coil 61*a* of the A.C. supervisory circuit to close the switches of that relay. Switch 61*b* will operate the automatic telephone dialer. Switch 61*c* will energize horn 73, light 69 and light 142, as previously described. Likewise, switch 61*d* will energize remote emergency signal 107.

Assuming that one of the remote emergency detectors 110, 111, 112, etc., identify the existence of one of the other emergency conditions, the respective switch will be opened. For example, assume that switch 113 opens. This likwise breaks the circuit through relay coil 61*a* of the A.C. supervisory circuit so as to allow the switches of that relay to close. There will be the same result as described in the preceding paragraph.

I claim:

1. In an apparatus for use with a sump in which there is an emergency sump pump driven by a direct current emergency sump pump motor operated from a rechargeable battery charged by a battery charger from an alternating current power source, and including sensor means to detect the level of liquid in the sump at which said motor should be operated, and direct current circuit means connecting said motor, said power source, and said sensor means, the improvement comprising:

said direct current circuit means including a switch which is closed when said motor is energized;

wiring means connected to said alternating current power source, to said battery charger and to said switch to energize said battery charger for the charging of said battery when said motor is energized.

2. In an apparatus as set forth in claim 1, including timer means connected to said alternating current power source and having a switch opened and closed at timed intervals, wiring means connected to said alternating current power source, said timer means switch and the battery charger for energizing the battery charger to charge the battery when the latter switch is closed.

3. In an apparatus as set forth in claim 2, wherein said sensor means comprises water depth sensing means adapted to be positioned in said sump for producing an increased fluid pressure as the water level in the sump rises above the water depth sensing means, a fluid pressure actuator, a conduit connecting said water depth sensing means and said actuator for transmitting fluid pressure therebetween, and switch means connected to the actuator to be rendered effective by an increase in fluid pressure in the water depth sensing means, said switch means being connected in said direct current circuit means for energizing said motor when said switch means is rendered effective.

4. In an apparatus as set forth in claim 3, wherein said water depth sensing means comprises a bell having an open bottom only, whereby the air pressure in the bell increases as the water level in the sump is above the bottom of the bell.

5. In an apparatus as set forth in claim 4, wherein said switch means comprises a normally open switch which is closed and thus rendered effective by an increase in pressure in the actuator, said apparatus including a manually operable, normally open, test switch connected in parallel with the switch of the sensor means.

6. In an apparatus as set forth in claim 4, wherein the bell is mounted on said sump pump and the sump pump has an intake tube extending to a level substantially below the bottom of said bell.

7. In an apparatus as set forth in claim 3 including:

first relay means comprising a first control element and a first, normally closed, signaling switch means operable to switch open condition when power is applied to said control element;

wiring means connecting said first control element to said alternating current power source to maintain said first signaling switch means open when power is supplied to said first control element from said alternating current power source;

second relay means comprising a second control element and a second, normally closed, signaling switch means operable to switch open condition when power is applied to the control element thereof;

wiring means connecting said second control element to said battery to maintain said second signaling switch means open when power is supplied to said second control element from said battery;

first sensible signaling means operable from alternating current;

second sensible signaling means operable from direct current;

wiring means connecting said battery, said first signaling switch means and said second sensible signaling means whereby a sensible signal is produced when the alternating current power source fails; and wiring means connecting the alternating current power source, said second normally closed signaling switch means and said first sensible signaling means whereby a sensible signal is produced when the battery power is inadequate.

8. In an apparatus as set forth in claim 7, including:

a second water level sensor means positioned in said sump for detecting water level in the sump higher than the water level detected by the first mentioned sensor means, said second water level sensor means including a switch actuated to effective condition by said higher water level in the sump, and wiring means connecting direct current circuit means to the last mentioned switch to energize the motor when said last mentioned switch is in the effective condition.

9. In an apparatus as set forth in claim 8, wherein said second relay means includes a normally closed, motor control switch means operable to switch open condition when power is applied to the control element thereof, said effective condition of said switch of said second water level sensing means being a circuit closed condition, said last mentioned wiring means and said wiring means for said control element of said second relay means forming a series circuit including said control element of said second relay means, said switch of said second water level sensing means and said battery whereby said normally closed motor control switch means is in circuit closed condition when said switch of said second water level sensing means is open, said normally closed motor control switch means being connected in parallel with said switch connected to the actuator.

10. In an apparatus as set forth in claim 9, wherein said direct current circuit means includes a circuit breaker for producing an open circuit and stopping the motor when there is an overload through the motor, said series circuit including said control element also including said circuit breaker whereby when the latter produces an open circuit said control element of said second relay means is deenergized.

11. In an apparatus as set forth in claim 10,
wherein said second relay means includes a third normally closed signaling switch means, and
including a third sensible signaling means operable from direct current, and wiring means connecting said third normally closed signaling switch means, said battery and said third sensible signaling means whereby the latter is energized when the control element of the second relay means is deenergized.

12. In an apparatus as set forth in claim 11,
wherein said first relay means includes a fourth normally closed signaling switch means,
including a fourth sensible signaling means operable from direct current, and wiring means connecting said fourth normally closed signaling switch means, said battery source and said fourth sensible signaling means whereby the latter is energized when the control element of the first relay means is deenergized,
one of said first and fourth sensible signaling means being located at a remote location whereby the wiring means therefor extends to said remote location and thereby is more subject to damage and short circuiting, and
said wiring means for said remotely located sensible signaling means including a fuse and a sensible signaling means in parallel with the fuse whereby it is rendered effective when the fuse is blown.

13. In an apparatus as set forth in claim 12,
including a remote panel having sensible signaling means as a counterpart of each of said previously mentioned sensible signaling means except for said remotely located sensible signaling means, and
including wiring means connecting each of said sensible signaling means of said remote panel with its counterpart to be rendered effective when its counterpart is effective.

14. In an apparatus for use with an alternating current power source and a sump in which there is an emergency sump pump driven by a direct current emergency sump pump motor operated from a direct current power source, and including sensor means to detect the level of liquid in the sump and having a switch which is then rendered effective to operate said motor, and direct current circuit means connecting said motor, said direct current power source, and said sensor means, the improvement comprising:
first relay means comprising a first control element and a first, normally closed, signaling switch means operable to switch open condition when power is applied to said control element;
wiring means connecting said first control element to said alternating current power source to maintain said first signaling switch means open when power is supplied to said first control element from said alternating current power source;
second relay means comprising a second control element and a second, normally closed, signaling switch means operable to switch open condition when power is applied to the control element thereof;
wiring means connecting said second control element to said direct current power source to maintain said second signaling switch means open when power is supplied to said second control element;
first sensible signaling means operable from alternating current;
second sensible signaling means operable from direct current;
wiring means connecting said direct current power source, said first signaling switch means and said second sensible signaling means whereby a sensible signal is produced when the alternating current power source fails; and
wiring means connecting the alternating current power source, the second normally closed signaling switch means and the first sensible signaling means whereby a sensible signal is produced when the power of said direct current power source is inadequate.

15. In an apparatus as set forth in claim 14, including:
a second water level sensor means positioned in said sump for detecting water level in the sump higher than the water level detected by the first mentioned sensor means, said second water level sensor means including a switch actuated to effective condition by said higher water level in the sump, and
wiring means connecting said direct current circuit means to the last mentioned switch to energize the motor when said last mentioned switch is in the effective condition.

16. In an apparatus as set forth in claim 15, wherein
said second relay means includes a normally closed motor control switch means operable to switch open condition when power is applied to the control element thereof, said effective condition of said switch of said second water level sensing means being a circuit closed condition,
said last mentioned wiring means and said wiring means for said control element of said second relay means forming a series circuit including said control element of said second relay means, said switch of said second water level sensing means and said direct current power source whereby said normally closed motor control switch means is in circuit closed condition when said switch of said second water level sensing means is open, said normally closed motor control switch means being connected in parallel with the switch of the first mentioned sensor means.

17. In an apparatus as set forth in claim 16, wherein said direct current circuit means includes a circuit breaker for producing an open circuit and stopping the motor when there is an overload through the motor, said series circuit including said control element also including said circuit breaker whereby when the latter produces an open circuit said control element of said second relay means is deenergized.

18. In an apparatus as set forth in claim 17,
wherein said second relay means includes a third normally closed signaling switch means, and
including a third sensible signaling means operable from direct current, and wiring means connecting said third normally closed signaling switch means, said direct current power source and said third sensible signaling means whereby the latter is energized when the control element of the second relay means is deenergized.

19. In an apparatus as set forth in claim 18,
wherein said first relay means includes a fourth normally closed signaling switch means,
including a fourth sensible signaling means operable from direct current, and wiring means connecting said fourth normally closed signaling switch means, said direct current power source and said fourth sensible signaling means whereby the latter is energized when the control element of the first relay means is deenergized, one of said first and fourth sensible signaling means being located at a remote location whereby the wiring means therefor extends to said remote location and thereby is more subject to damage and short circuiting, and said wiring means for said remotely located sensible signaling means including a fuse and a sensible signaling means in parallel with the fuse whereby it is rendered effective when the fuse is blown.

20. In an apparatus as set forth in claim 19, including sensible signaling means connected in parallel with said motor to be energized when said motor is energized.

21. In an apparatus as set forth in claim 20, including a remote panel having sensible signaling means as a counterpart of each of said previously mentioned sensible signaling means except for said remotely located sensible signaling means, and including wiring means connecting each of said sensible signaling means of said remote panel with its counterpart to be rendered effective when its counterpart is effective.

22. In an apparatus as set forth in claim 19 for use with an automatic telephone dialer, the further improvement comprising:

one of said relay means including a normally closed, automatic dialer switch means, and wiring means for connecting the latter switch means with said automatic dialer to actuate the latter when the control element of said one relay means is deenergized.

23. In an apparatus as set forth in claim 14, wherein said second relay means includes a third normally closed signaling switch means, and including a third sensible signaling means operable from direct current, and wiring means connecting said third normally closed signaling switch means, said direct current power source and said third sensible signaling means whereby the latter is energized when the control element of the second relay means is deenergized.

24. In an apparatus as set forth in claim 23, wherein said first relay means includes a fourth normally closed signaling switch means, including a fourth sensible signaling means operable from direct current, and wiring means connecting said fourth normally closed signaling switch means, said direct current power source and said fourth sensible signaling means whereby the latter is energized when the control element of the first relay means is deenergized, one of said first and fourth sensible signaling means being located at a remote location whereby the wiring means therefor extends to said remote location and whereby is more subject to damage and short circuiting, and said wiring means for said remotely located sensible signaling means including a fuse and a sensible signaling means in parallel with the fuse whereby it is rendered effective when the fuse is blown.

25. In an apparatus as set forth in claim 14, including a plurality of remote sensors for at least one detrimental condition, said remote sensors each including a normally closed switch which is opened when the respective detrimental condition is detected by that sensor, and wherein the wiring means connected to the control element of one of said relay means includes the switches of the remote sensors in a series circuit whereby said control element of one of said relay means is deenergized when a detrimental condition is detected by one of said remote sensors, thereby energizing the signaling means connected to said one relay means.

26. In an apparatus as set forth in claim 25 for use with an automatic telephone dialer, the improvement comprising:

said one relay means including a normally closed, automatic dialer switch means, and wiring means for connecting the latter switch means with said automatic dialer to actuate the latter when the control element of said one relay means is deenergized.

27. In an apparatus as set forth in claim 25, wherein said one of said relay means is said first relay means.

28. In an apparatus as set forth in claim 27, wherein said direct current circuit means includes third relay means comprising a third control element and a normally open switch means operable to switch closed condition when power is applied to said third control element, said normally open switch means being in series with said motor;

wherein said second relay means including a normally closed motor control switch means operable to switch open condition when power is applied to said second control element; and including wiring means connecting said motor control switch means, said direct current power source and said third control element to close said normally open switch means of said third relay means and energize said motor when said motor control switch means is closed.

29. In an apparatus as set forth in claim 14, wherein said direct current circuit means includes third relay means comprising a third control element and a normally open switch means operable to switch closed condition when power is applied to said third control element, said normally open switch means being in series with said motor;

wherein said second relay means including a normally closed motor control switch means operable to switch open condition when power is applied to said second control element; and including wiring means connecting said motor control switch means, said direct current power source and said third control element to close said normally open switch means of said third relay means and energize said motor when said motor control switch means is closed.

30. In an apparatus as set forth in claim 29, wherein said switch of said sensor means is connected in parallel with said motor control switch means;

including a second water level sensor means for detecting water level in the sump higher than the water level detected by the first mentioned sensor means, said second water level sensor means including a normally closed switch opened by said higher water level in the sump; and wherein said wiring means connecting said second control element includes said switch of said second water level sensor means whereby when the latter switch is open said normally open switch means is closed for energizing said motor.

31. In an apparatus as set forth in claim 24, including a remote panel having sensible signaling means as a counterpart of each of said previously mentioned sensible signaling means, and including wiring means connecting each of said sensible signaling means of said remote panel with its counterpart to be rendered effective when its counterpart is effective.

32. In an apparatus as set forth in claim 14 and for use with an automatic telephone dialer, the further improvement comprising:

one of said relay means including a normally closed, automatic dialer switch means, and wiring means for connecting the latter switch means with said automatic dialer to actuate the latter when the control element of said one relay means is deenergized.

33. In an apparatus for use with power source means including an alternating current power source and a direct current power source, and for use with a sump in which there is an emergency sump pump driven by a direct current emergency sump pump motor operated from said direct current power source, and including sensor means to detect the level of liquid in the sump and having a switch which is then rendered effective to operate said motor, and direct current circuit means connecting said motor, said direct current power source, and said sensor means, the improvement comprising:

first relay means comprising a first control element and a first, normally closed, signaling switch means operable to switch open condition when power is applied to said control element;

wiring means connecting said first control element to said alternating current power source to maintain said first signaling switch means open when power is supplied to said first control element from said alternating current power source;

second relay means comprising a second control element, a second, normally closed, signaling switch means operable to switch open condition when power is applied to the control element thereof, and a normally closed motor control switch means operable to switch open condition when power is applied to said second control element;

wiring means connecting said second control element to said direct current power source to maintain said second signaling switch means open so long as said second control element is energized:

said direct current circuit means including third relay means comprising a third control element and a normally open switch means operable to switch closed condition when power is applied to said third control element, said normally open switch means being in series with said motor;

wiring means connecting said motor control switch means, said direct current power source and said third control element to close said normally open switch means of said third relay means and energize said motor when said motor control switch means is closed;

sensible signaling means;

wiring means connecting said power source means, said normally closed signaling switch means and said sensible signaling means whereby a sensible signal is produced when power is not being applied to said control elements of said first and second relay means.

34. In an apparatus as set forth in claim 33 and for use wherein the direct current power source includes a rechargeable battery charged by a battery charger, the further improvement, wherein said third relay means includes normally open charger switch means operable to switch closed condition when power is applied to said third control element; and including wiring means connected to said alternating current power source, to said battery charger and to said charger switch means to energize said battery charger for the charging of said battery when said switches of said third relay means are closed and the motor is energized.

35. In an apparatus as set forth in claim 33, wherein said direct current means includes a circuit breaker for producing an open circuit and stopping the motor when there is an overload through the motor, said wiring means connected to said second control element also including said circuit breaker whereby when the latter produces an open circuit said control element of said second relay means is deenergized.

36. In an apparatus as set forth in claim 35, wherein said switch of said sensor means is a normally open switch closed by the sensor detecting excess water in the sump, said sensor means switch being connected in parallel with said normally closed motor control switch means;

including a second water level sensor means for detecting water level in the sump higher than the water level detected by the first mentioned sensor means, said second water level sensor means including a normally closed switch opened by said higher water level in the sump; and wherein said wiring means connecting said second control element includes said switch of said second water level sensor means whereby when the latter switch is open said normally open switch means is closed for energizing said motor.

* * * * *

UNITED STATES PATENT AND TRADEMARK OFFICE

CERTIFICATE OF CORRECTION

PATENT NO. : 3,941,507

DATED : March 2, 1976

INVENTOR(S) : Karl O. Niedermeyer

It is certified that error appears in the above-identified patent and that said Letters Patent are hereby corrected as shown below:

Column 2, lines 49-50, "disadvantages" should read --disadvantage--.

Column 4, line 9, "80e" should read --81e--.
Column 4, line 40, "wire" should read --wires--.
Column 8, line 38, --said-- should be inserted after "connecting".
Column 9, line 16, "source" should be deleted.
Column 10, line 14, delete the colon.
Column 11, line 59, "whereby" should read --thereby--.
Column 13, line 52, the colon should be a semicolon.
Column 14, line 31, --circuit-- should be inserted after "current".

Signed and Sealed this

Twenty-fourth Day of August 1976

[SEAL]

*Attest:*

RUTH C. MASON
*Attesting Officer*

C. MARSHALL DANN
*Commissioner of Patents and Trademarks*